US006296178B1

(12) United States Patent
McKenna, Sr.

(10) Patent No.: US 6,296,178 B1
(45) Date of Patent: Oct. 2, 2001

(54) CONTAINER WITH TRIANGULAR CORNER POSTS

(75) Inventor: David J. McKenna, Sr., Tumwater, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/636,396

(22) Filed: Aug. 9, 2000

(51) Int. Cl.[7] ..... B65D 5/00

(52) U.S. Cl. ..... 229/165; 229/191; 229/918; 229/174

(58) Field of Search ..... 229/165, 191, 229/918, 195, 174

(56) References Cited

U.S. PATENT DOCUMENTS

| | | | | |
|---|---|---|---|---|
| 2,006,203 | | 6/1935 | Leslie . | |
| 2,163,117 | | 6/1939 | Evans et al. . | |
| 2,295,141 | | 9/1942 | Van Wingen . | |
| 2,804,252 | | 8/1957 | Nute . | |
| 2,894,672 | | 7/1959 | Bamburg . | |
| 2,934,250 | | 4/1960 | Stotz . | |
| 2,986,320 | | 5/1961 | Nicholls et al. . | |
| 3,034,698 | | 5/1962 | Forrer . | |
| 3,055,573 | * | 9/1962 | Carter | 229/918 X |
| 3,102,674 | | 9/1963 | Hamilton . | |
| 3,375,967 | * | 4/1968 | Robinson | 229/918 X |
| 3,871,570 | * | 3/1975 | Garmon | 229/143 |
| 3,940,053 | | 2/1976 | Putman et al. . | |
| 4,082,215 | | 4/1978 | Eichenauer . | |
| 4,266,714 | | 5/1981 | Crane . | |
| 4,356,952 | | 11/1982 | Rekow . | |
| 4,469,273 | | 9/1984 | Smith . | |
| 4,537,344 | | 8/1985 | Thomas . | |
| 4,546,913 | | 10/1985 | Castillo . | |
| 4,567,996 | | 2/1986 | Muise . | |
| 4,600,142 | | 7/1986 | Quaintance . | |
| 4,770,339 | | 9/1988 | Weimer . | |
| 4,860,948 | * | 8/1989 | Hofstede | 229/143 |
| 4,883,221 | | 11/1989 | Brundage . | |
| 5,028,000 | | 7/1991 | Chabot et al. . | |
| 5,125,568 | | 6/1992 | Bauer . | |
| 5,203,494 | | 4/1993 | Blomfield . | |
| 5,261,594 | | 11/1993 | Brown et al. . | |
| 5,285,956 | | 2/1994 | Piepho . | |
| 5,433,373 | | 7/1995 | Zoeller . | |
| 5,458,283 | | 10/1995 | Southwell et al. . | |
| 5,516,034 | | 5/1996 | Jensen et al. . | |
| 5,535,941 | | 7/1996 | Garza . | |
| 5,549,242 | * | 8/1996 | Gimeno | 229/918 X |
| 5,649,663 | | 7/1997 | Pestow, Jr. . | |
| 5,673,848 | | 10/1997 | Garza . | |
| 5,860,590 | | 1/1999 | Blomfield et al. . | |
| 5,913,474 | | 6/1999 | Chu . | |

* cited by examiner

*Primary Examiner*—Gene Mancene
*Assistant Examiner*—Tri M. Mai
(74) *Attorney, Agent, or Firm*—Christensen O'Connor Johnson & Kindness PLLC

(57) ABSTRACT

A single-piece containerboard blank (10) is provided having hingedly-connected first and second side walls (26), (34) in which the second side wall (26) is smaller in length than the first side wall (34). The second side walls each include an outer abutment edge (42). The first side walls include first and second interior end walls (50), (52). Each second interior end wall (52) includes a hypotenuse panel (62) with an inwardly-oriented edge (66). As assembled, the blank (10) forms a container having opposed multi-ply side panels, opposed end panels, and a bottom panel. The hypotenuse panels (62) are oriented in an upright manner and ultimately positioned so that their inwardly-oriented edges (66) push against the first side wall and preferably also against the abutment edges (42) of the second side wall (34). The hypotenuse panels (62) offer stacking strength and reinforcement to the container. In one embodiment, tabs (92) and mating openings (96) are provided to help stabilize the container when multiple containers are placed in a stack. In another embodiment, top closure panels (100) are provided to close off the upper portions of the container.

9 Claims, 7 Drawing Sheets

CONTAINER WITH TRIANGULAR CORNER POSTS

FIELD OF THE INVENTION

The present invention relates to corrugated paperboard containers, and more particularly, to single-piece container blanks capable of forming triangular reinforcing columns within the container's interior as assembled.

BACKGROUND OF THE INVENTION

Containers used to package perishable items, such as fruits and vegetables, must meet a variety of requirements. One important requirement is that the container be strong enough to contain the product from the time it is packed until the time it is unpacked. It is also important that the container have sufficient stacking strength so that several containers may be stacked vertically during shipment. Another desirable feature for efficient transportation is to have stacking tabs protruding from one container and insertable into an opening of adjacent container to prevent sway and possible destacking. See for example, U.S. Pat. No. 3,940,053.

One known method of gaining additional container strength is to use some type of triangular corner post within the container. See for example, U.S. Pat. No. 5,535,941. Typically, such arrangements have complicated blanks, are difficult to form, or require excessive gluing in order to maintain their shape. These can all be significant disadvantages for container makers, since additional effort is needed to cut and create the finished boxes, thereby adding to their production cost.

SUMMARY OF THE INVENTION

The present invention is directed to providing a single-piece containerboard blank from which a box is easily formed and maintained. The present invention includes an arrangement in which the various box panels naturally correspond to keep their relative positions, thus ensuring good container strength throughout the container's use. The present invention may be made with various stacking tabs to improve its stack-ability, as well.

In accordance with aspects of the present invention, a single-piece containerboard blank is provided having hingedly connected first and second side walls in which the second side wall is smaller in length than the first side wall. The second side walls include outer abutment edges. The first side walls include first and second interior end walls. Each second interior end wall includes a hypotenuse panel with an inwardly-oriented edge. As assembled, the blank forms a container having opposed multi-ply side panels, opposed end panels, and a bottom panel. The hypotenuse panels are oriented in an upright manner and ultimately positioned so that their inwardly-oriented edges push against the first side wall, and in one embodiment, further push directly against the abutment edges of the second side wall.

In accordance with other aspects of the invention, tabs and mating openings are provided to help stabilize the container when multiple containers are placed in a stack. In another embodiment, top closure panels are provided to close off the upper portions of the container. The top closure panels may each include a notch that mates with an upright tab as assembled.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
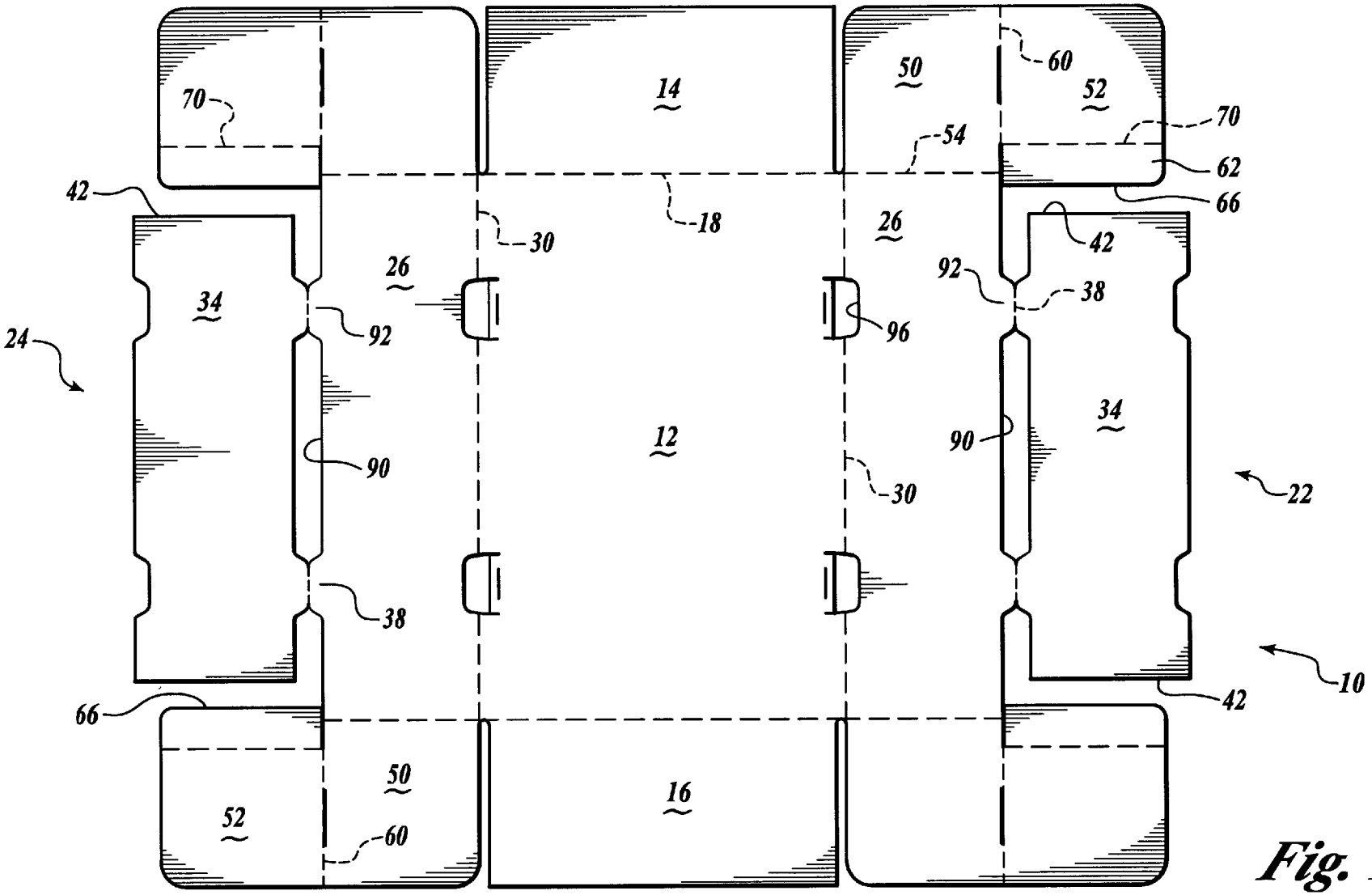
FIG. 1 is a plan view of one embodiment of a box blank formed in accordance with the present invention.

Referring now to the drawings, the several separate and distinct panels comprising the container blank, generally depicted at 10, will be described. It is to be noted that the container blank 10 is comprised of a single-piece of containerboard material such as are known to those of skill in the art, e.g., double-faced corrugated medium or the like. The central portion of the container blank 10 is a bottom panel 12 which forms the bottom of the erected container. The bottom panel 12 is generally in the shape of a rectangle as is customary, although other planar configurations are within the scope of the present invention.

For the purpose of further description herein, the longitudinal direction is defined as the direction along the longer dimension of the bottom panel, and the transverse direction is defined as the direction along the shorter dimension of the bottom panel.

Referring particularly to FIG. 1, end walls 14, 16 extend outwardly in the longitudinal direction from the transverse edges of the bottom panel along respective first transverse hinge lines 18, 20. In the erected state, the end walls 14, 16 form a portion of the overall container end panels. The hinge lines described herein are generally fold lines that may be formed in a conventional manner depending on the materials and forming methods used.

Extending outwardly in the transverse direction are side panels generally indicated at 22 and 24. Each side panel includes a first side wall 26 extending outwardly from each longitudinal edge of the bottom panel and connecting thereto along a first longitudinal hinge line 30. The first side walls 26 form the outer wall in each of the side panels.

The side panels also include second side walls 34. One second side wall 34 extends outwardly from each first side wall 26 and is connected thereto along a second longitudinal hinge line 38. As the purpose will be made clear in the following description, each second side wall 34 is of a longitudinal length that is less than the longitudinal length of its corresponding first side wall 26. The transverse end edges of these shorter, second side walls 34 form abutment edges 42.

Still referring to FIG. 1, the ends of the first side walls 26 include first and second interior end walls 50, 52. These are termed "interior" because they are eventually placed adjacent to and attached to the end walls 14, 16 of the formed container. The first interior end walls 50 extend longitudinally outward from the transverse edges of the first side walls 26 and are connected thereto along second transverse hinge lines 54. The first and second transverse hinge lines 18, 54 are generally collinear, though slight nonlinearity may be provided to ease the forming of the container.

A second interior end wall extends transversely outward from the outer edge of each first interior end wall 50 and connects thereto along a third longitudinal hinge line 60. Each second interior end wall 52 has a hypotenuse panel 62 that extends longitudinally inward toward the abutment edge 42 of the adjacent second side wall 34. The hypotenuse panel 62 has an inwardly-oriented edge 66 and is connected to the second interior end wall 52 along a third transverse hinge line 70. As shown best in FIG. 1, the third transverse hinge line 70 is located outward of the second transverse hinge line 54 and parallel thereto.

The transverse dimension of the first and second interior end walls 50, 52 is preferably equal to the longitudinal dimension of the end walls, so that, as erected, the first and second interior end walls are substantially the same height as the end walls.

Figure 7:
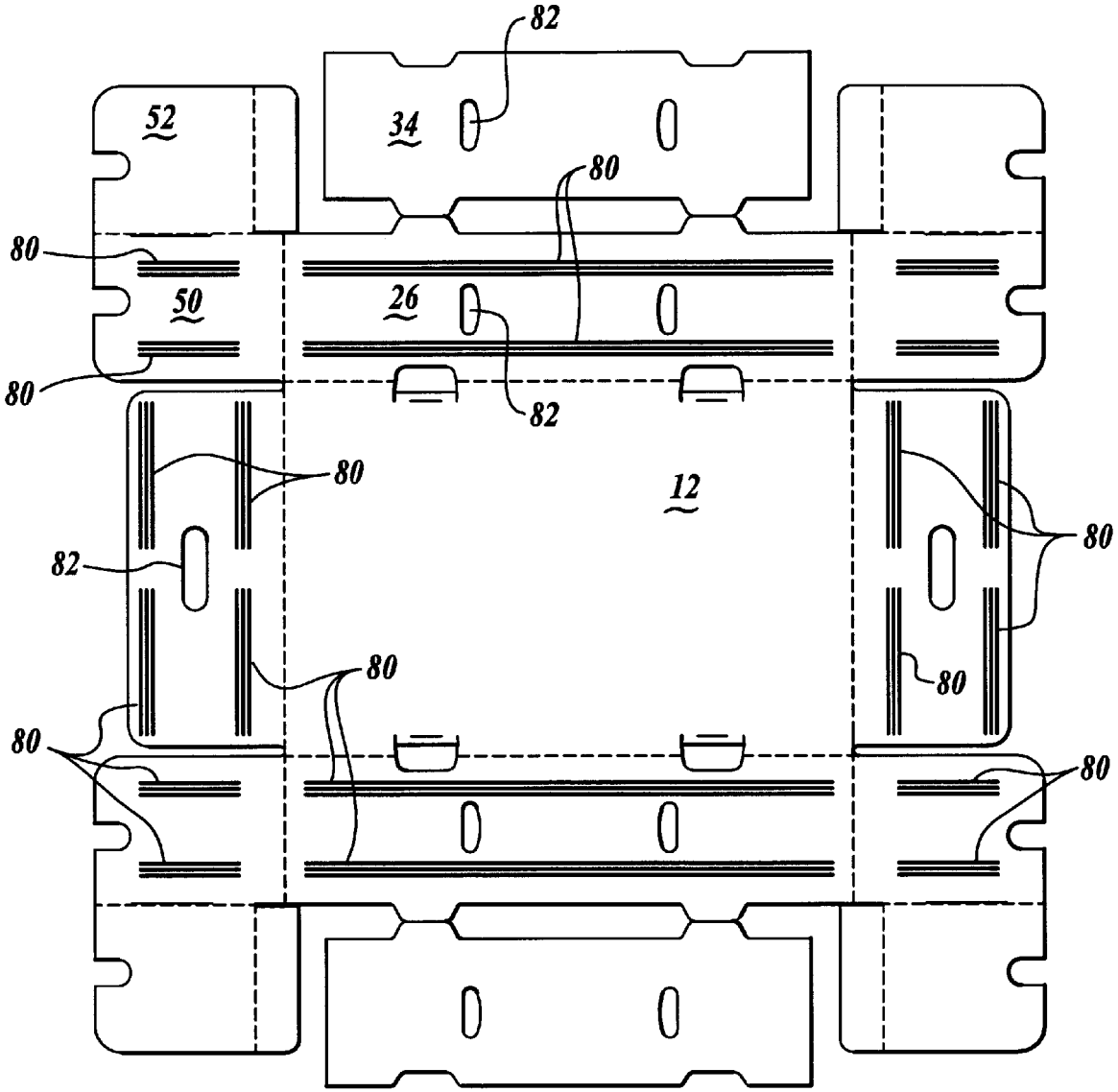
FIG. 7 is one embodiment of glue lines that may be used in the present invention.

It should be appreciated by those skilled in the art that the present container blank 10 can be erected on suitable automatic machinery such as a modified tray former. Likewise, the blank 10 can be erected manually through appropriate folding. Prior to folding, an adhesive is applied to the container blank 10, as appropriate. See FIG. 7 for one embodiment of adhesive lines that may be used in the present invention. Adhesive lines are designated collectively as elements 80 in FIG. 7. (Various optional openings 82 are shown as well.) It should be understood that FIG. 7 is illustrative and not limiting to the present invention. Other configurations of adhesive sizes, shapes, numbers of applications, or placements may be used as would be understood by one of ordinary skill in the art. An example adhesive may be a suitable hot melt which could be applied through automatic applying means known to those skilled in the art, or other known adhesive.

Figure 2:
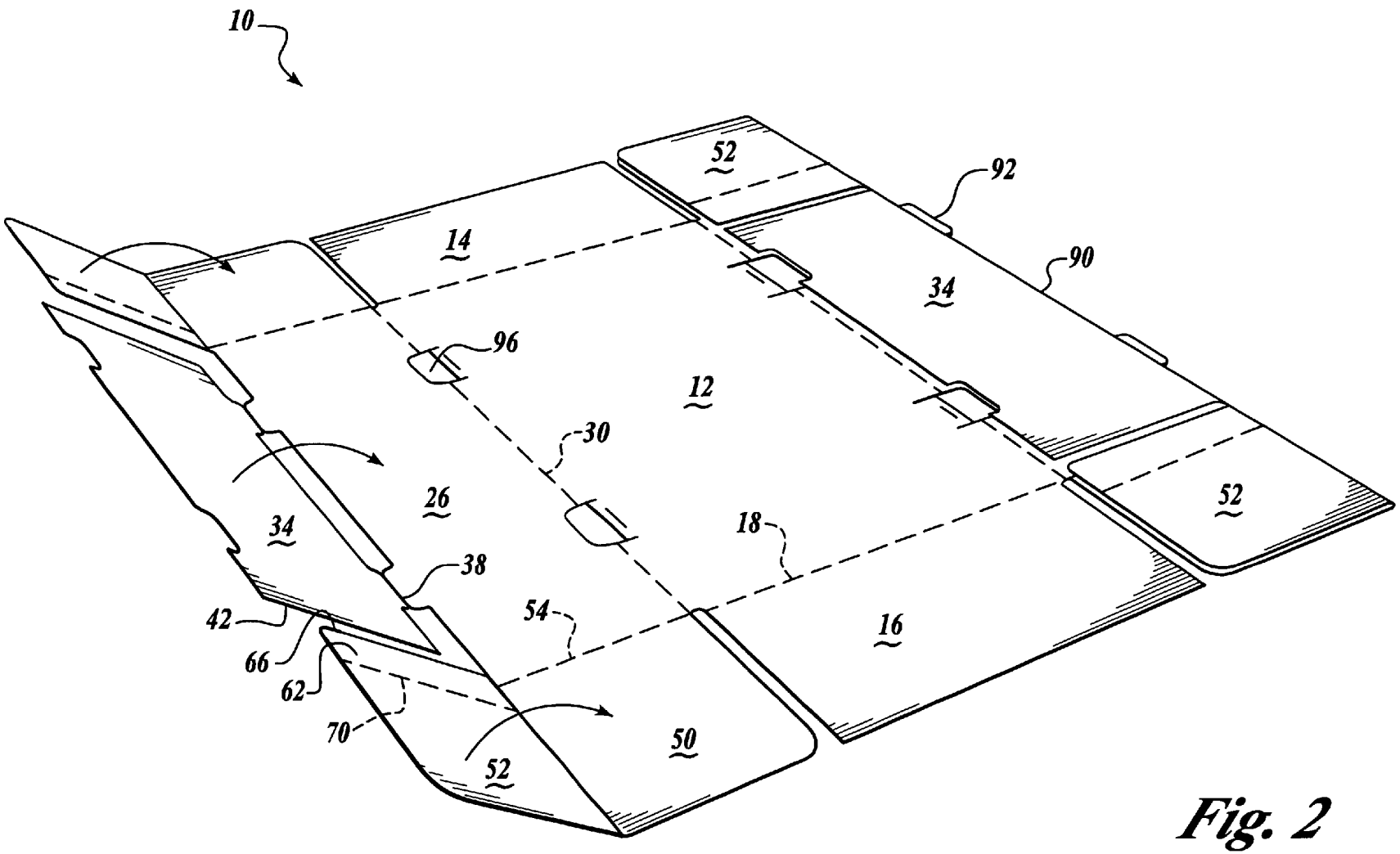
FIG. 2 is a perspective view of the embodiment of FIG. 1, as partially assembled.

As shown in FIG. 2, the first step in forming the container is to fold the second interior end walls 52 over 180° along the third longitudinal hinge lines 60 such that the second interior end walls 52 are positioned against the first interior end walls 50. Likewise, the second side walls 34 are folded along the second longitudinal line 38 180° over onto their corresponding first side walls 26. The combination first and second interior end walls 50, 52 are then folded upward 90° to assume an upright orientation that is perpendicular to the side walls. (See the right-hand side of FIG. 2.)

In doing this, the hypotenuse panel 62 will interfere with the first side wall 26, since the hypotenuse panel 62 folds about the third transverse hinge line 70 which is outward of the second transverse hinge line 54 and since the hypotenuse inwardly-oriented edge 66 is inward of the second transverse hinge line 54. Thus, in order to form the 90° orientation, the hypotenuse panel 62 must be pushed upward and away from the first interior end wall 50. In doing so, the inwardly-oriented hypotenuse edge 66 will rest against the first side wall 34 and preferably against the second side wall abutment edge 42. In designing a particular container, the second side wall 34, hypotenuse panel 62, and various transverse hinge lines are preferably dimensioned so that the hypotenuse inwardly-oriented edge is contained by the abutment edge 42.

Figure 3:
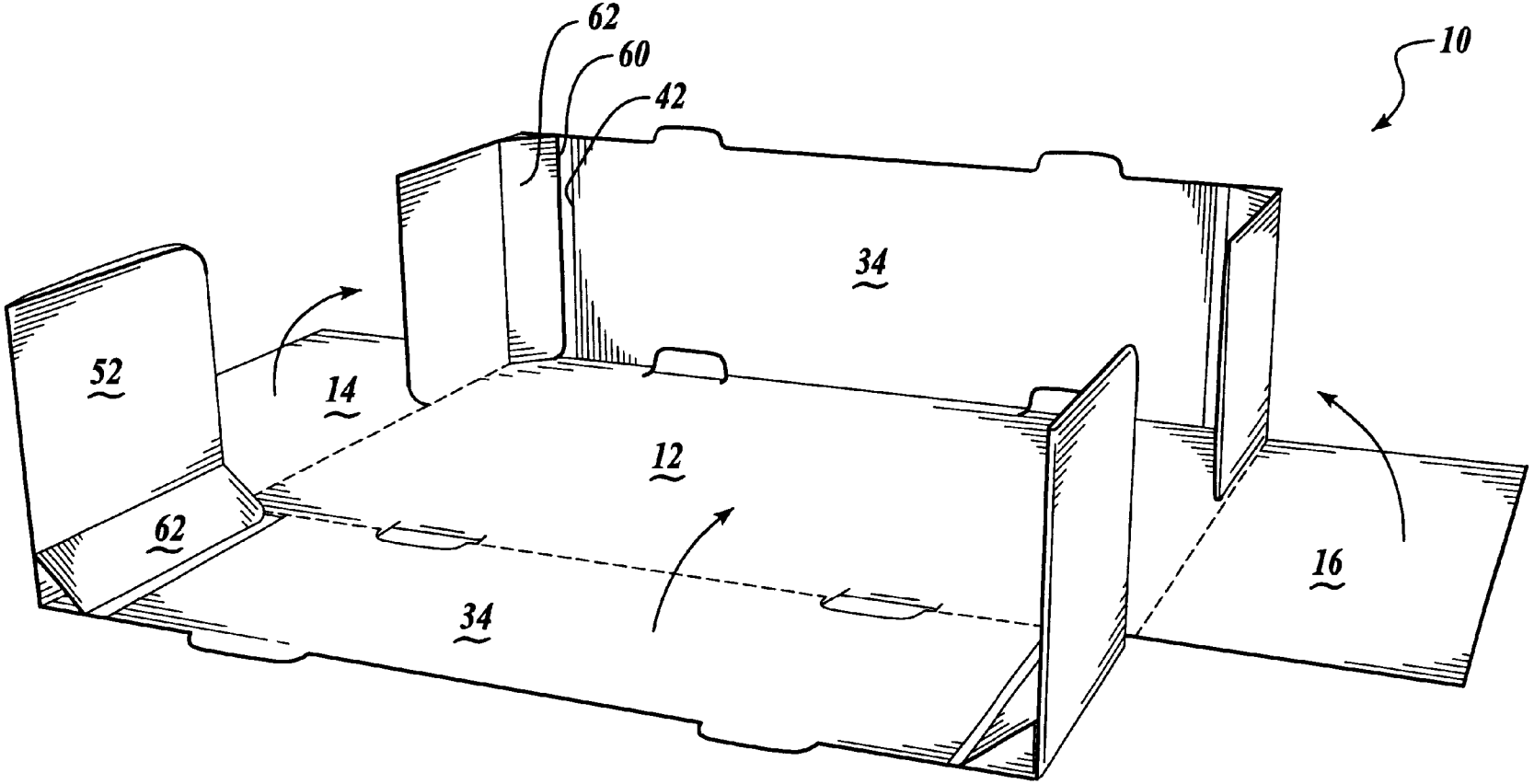
FIG. 3 is a perspective view of the embodiment of FIG. 1, as further partially assembled.
Figure 4:
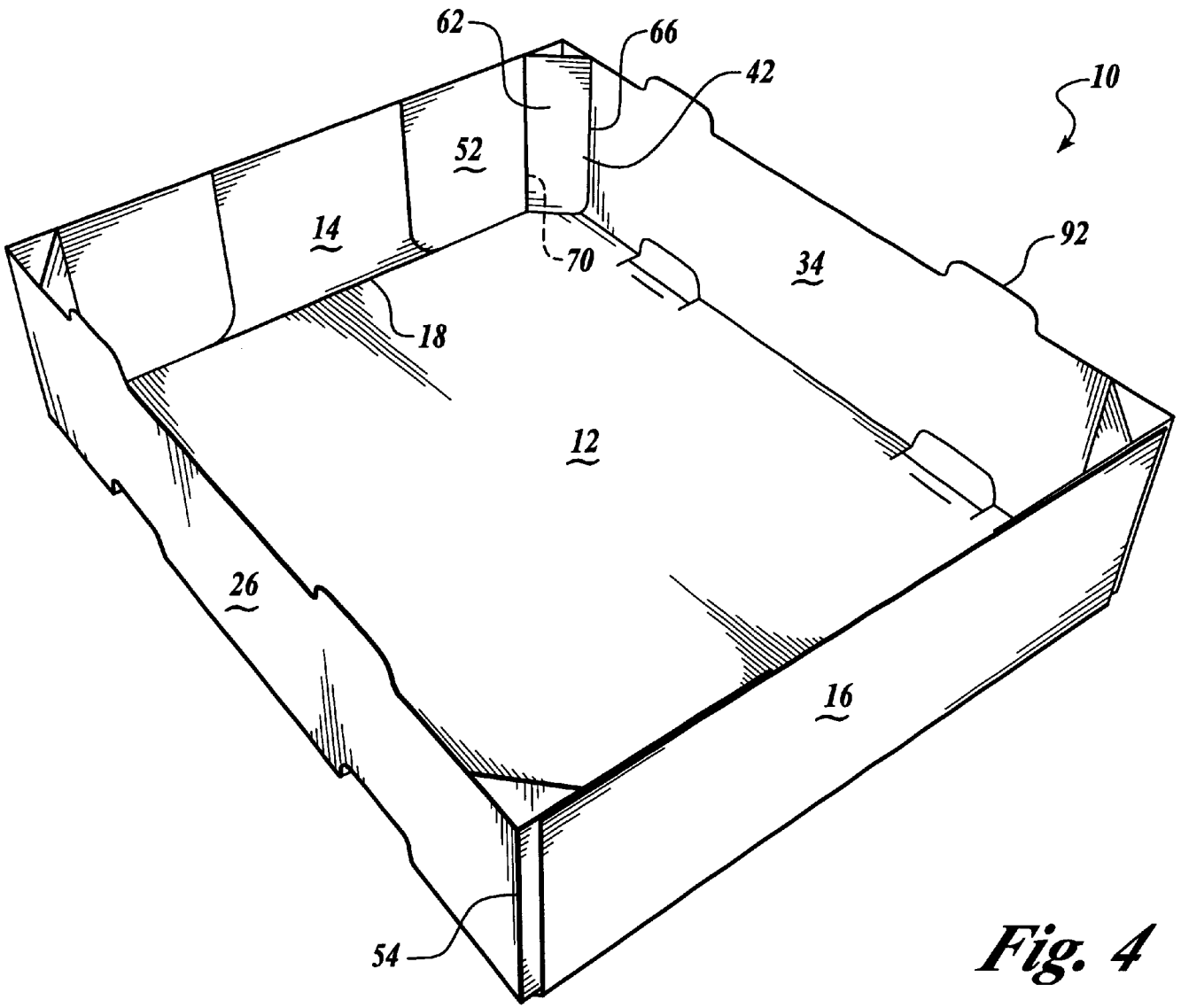
FIG. 4 is a perspective view of the embodiment of FIG. 1, as assembled.

Continuing construction to FIG. 3, the combination of end and side walls are folded along the first longitudinal hinge lines 30. Lastly, the end walls 14, 16 are folded upward 90° and joined with the exterior surface of the first interior end wall 50. Variations in formation may be made. For example, the end walls may be inserted between the first and second interior end walls by varying the forming steps. What is important is the formation of triangular corner posts using the hypotenuse panel. Because this panel is folded from the second interior end wall, it has a tendency to push against the first side wall. In one embodiment, the tolerance between the abutment edge and the inwardly-oriented edge are small enough so that the hypotenuse panel is effectively trapped by the abutment edge and cannot move further inward into the container.

Referring to FIG. 1, the blank may optionally include a number of cutouts 90 along the second longitudinal hinge line 38. As assembled, the remaining portions form a number of upright tabs 92. Openings 96 formed along the first longitudinal hinge line 30 provide corresponding apertures within which the tabs may be inserted when multiple containers are vertically stacked. The openings 96 are thus located and sized to accept an upright tab. As will be appreciated by the above, a plurality of vertically stacked erected containers are relatively stable because the stacking tabs tend to lock the stacked containers together. In this regard, the multiple ply of the side panels provide additional stacking strength as well.

Figure 5:
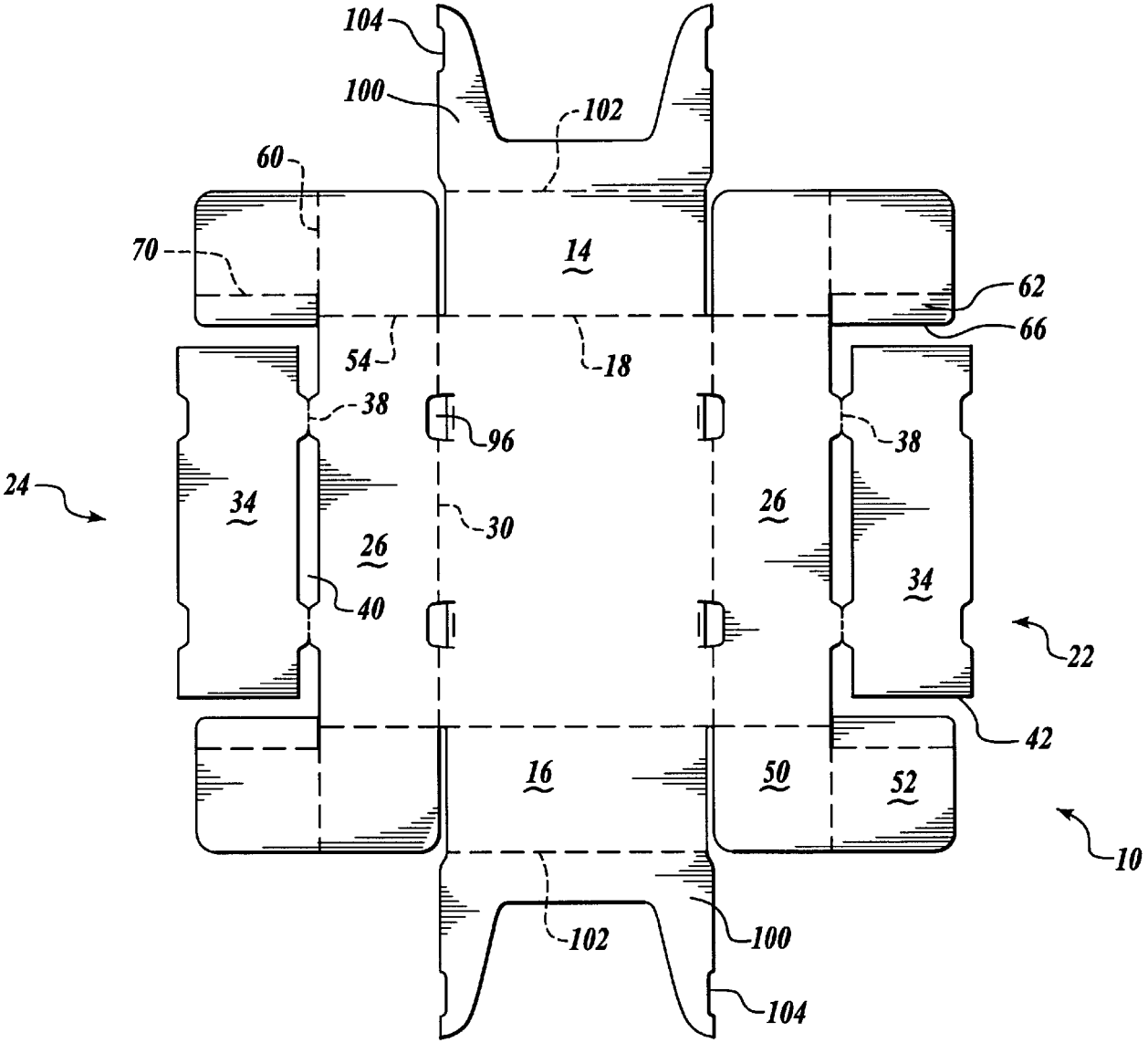
FIG. 5 is a plan view of a second embodiment of a box blank formed in accordance with the present invention.
Figure 6:
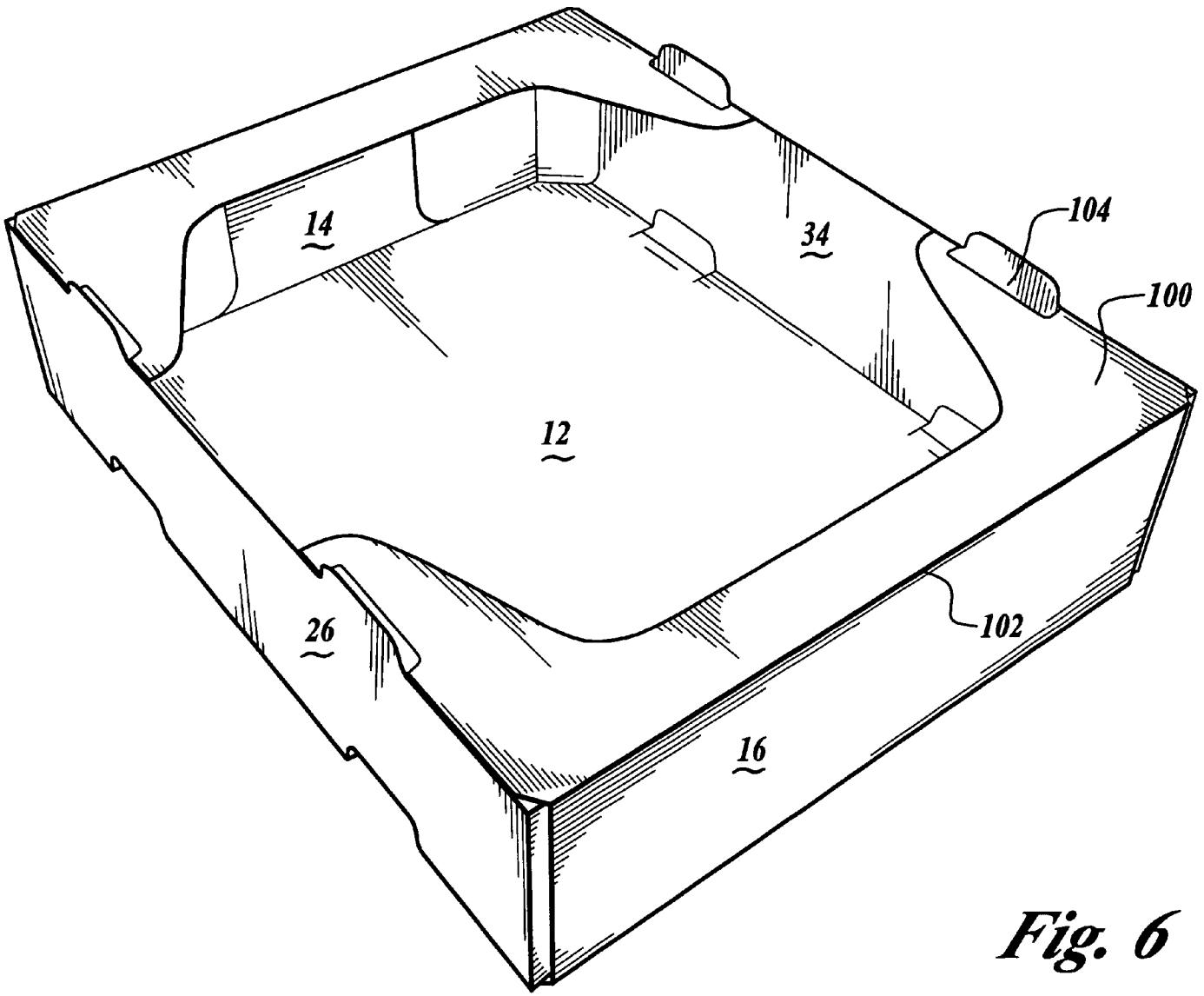
FIG. 6 is a perspective view of the embodiment of FIG. 5, as assembled.

Referring to FIGS. 5 and 6, the blank 10 may further optionally include top closure panels 100 connected to the end panels along fourth transverse hinge lines 102. There are numerous types of top closure panels that may be used. The ones shown in FIGS. 5 and 6 cover only a portion of the container as assembled and include notches 104 that mate with the upright tabs 92 for further stability and ease of alignment.

It will be appreciated by those skilled in the container art, the present invention provides an easily-formed and easily-assembled produce container from a single-piece containerboard material. The assembled container includes triangular corner posts that provide enhanced strength and stacking capability. The triangular corner posts are formed in a manner that encourages their proper placement, thus reducing the complexity of the box and the amount of adhesive required. The multi-ply side panels also provide enhanced construction and stacking strength.

While the preferred embodiment of the invention has been illustrated and described, it will be appreciated that various changes can be made therein without departing from the spirit and scope of the invention. All such modifications are intended to be included within the scope of the appended claims. For example, depending on the packing and transportation requirements, the end panel construction may be made of multiple plies. Or, for example, numerous types of lids or covers may be used.

The embodiments of the invention in which an exclusive property or privilege is claimed are defined as follows:

1. A single-piece containerboard blank erectable into a container having two multi-ply side panels, two end panels, and a bottom panel, the box blank comprising:

(a) a generally rectangular bottom panel having longitudinal and transverse edges;

(b) end walls, one of the end walls extending outwardly from each transverse edge of the bottom panel and connected thereto along a first transverse hinge line;

(c) first side walls, one of the first side walls extending outwardly from each longitudinal edge of the bottom panel and connected thereto along a first longitudinal hinge line; the first side walls forming the outer wall in each of the side panels;

(d) second side walls, one of the second side walls extending outwardly from each first side wall and connected thereto along a second longitudinal hinge line; each of the second side walls being of a longitudinal length that is less than the longitudinal length of its corresponding first side wall; each of the second side walls having forward and aft abutment edges;

(e) first interior end walls extending longitudinally outward from the transverse edges of the first side walls and connected thereto along second transverse hinge lines; the first and second transverse hinge lines being generally collinear; and (f) second interior end walls extending transversely outward from each first interior end wall and connected thereto along a third longitudinal hinge line, the second interior end walls having a hypotenuse panel foldably connected to an inner edge of the second interior end wall along a third transverse hinge line: the hypotenuse panel extending longitudinally toward the second side wall abutment edges; the hypotenuse panel having an inwardly oriented edge; the third transverse hinge line being located outward of the second transverse hinge line and parallel thereto; the inwardly oriented edge of the hypotenuse panel being located inward of the second transverse hinge line; the hypotenuse panel being unconnected to its respective first interior end wall;

wherein as assembled, the second side wall folds down upon the first side wall at the second longitudinal hinge line and the combination folds generally perpendicular to the bottom panel along the first longitudinal hinge line so that the abutment edges are oriented in an upright manner, and the hypotenuse panels are also oriented in an upright manner and positioned so that their inwardly oriented edges push against the first side wall.

2. The single-piece blank according to claim 1, wherein the side walls and interior end walls are dimensioned so that the inwardly oriented edges of the hypotenuse panels also push against the abutment edges of the second side wall.

3. The single-piece blank according to claim 1, further comprising top closure panels connected to the end panels alone a fourth transverse hinge line.

4. The single-piece blank according to claim 1, further comprising a number of openings in the bottom panel.

5. The single-piece blank according to claim 1, further including cutouts in the second longitudinal hinge lines.

6. The single-piece blank according to claim 5, wherein the cutouts in the second longitudinal hinge lines form one or more upright tabs as assembled.

7. A single-piece containerboard blank of the type that is erectable into a container having two multi-ply side panels, two end panels, and a bottom panel, the box blank comprising:

(a) a generally rectangular bottom panel having longitudinal and transverse edges:

(b) end walls, one end wall extending outwardly from each transverse edge of the bottom panel and connected thereto along a first transverse hinge line;

(c) first side walls, one first side wall extending outwardly from each longitudinal edge of the bottom panel and connected thereto along a first longitudinal hinge line; the first side walls forming the outer wall in each of the side panels;

(d) second side walls, one second side wall extending outwardly from each first side wall and connected thereto along a second longitudinal hinge line; each second side wall being of a longitudinal length that is less than the longitudinal length of its corresponding first side wall; each second side wall having forward and aft abutment edges;

(e) first interior end walls extending longitudinally outward from the transverse edges of the first side walls and connected thereto along second transverse hinge lines; the first and second transverse hinge lines being generally collinear; and (f) second interior end walls extending transversely outward from each first interior end wall and connected thereto along a third longitudinal hinge line, the second interior end walls having a hypotenuse panel extending longitudinally toward the second side wall abutment edges; the hypotenuse panel having an inwardly oriented edge; the hypotenuse panel being connected to the second interior end wall along a third transverse hinge line; the third transverse hinge line being located outward of the second transverse hinge line and parallel thereto; the inwardly oriented edge being located inward of the second transverse hinge line;

wherein as assembled, the second side wall folds down upon the first side wall at the second longitudinal hinge line and the combination folds generally perpendicular to the bottom panel along the first longitudinal hinge line so that the abutment edges are oriented in an upright manner, and the hypotenuse panels are also oriented in an upright manner and positioned so that their inwardly oriented edges push against the first side wall; the box blank further including cutouts in the second longitudinal hinge lines;

wherein the cutouts in the second longitudinal hinge lines form one or more upright tabs as assembled; the box blank further comprising top closure panels connected to the end panels along a fourth transverse hinge line.

8. The single-piece blank according to claim 7, wherein the top closure panels each include a notch that mates with an upright tab as assembled.

9. The single-piece blank according to claim 8, further comprising a number of openings in the bottom panel, the openings being located and sized to accept an upright tab when multiple formed containers are stacked vertically.

* * * * *